US005927530A

United States Patent [19]

Moore

[11] Patent Number: 5,927,530

[45] Date of Patent: Jul. 27, 1999

[54] ANGLED TAB CLOSURE LINER

[75] Inventor: David N. Moore, Plainfield, Ill.

[73] Assignee: Phoenix Closures, Inc., Naperville, Ill.

[21] Appl. No.: 09/082,597

[22] Filed: May 21, 1998

[51] Int. Cl.[6] ..... B65D 39/00

[52] U.S. Cl. ..... 215/232; 215/349; 215/350

[58] Field of Search ..... 215/232, 349, 215/350

[56] References Cited

U.S. PATENT DOCUMENTS

| | | | |
|---|---|---|---|
| 3,815,314 | 6/1974 | Pollock et al. . | |
| 3,900,125 | 8/1975 | Wyler et al. . | |
| 3,973,719 | 8/1976 | Johnson et al. . | |
| 4,310,100 | 1/1982 | Kunimoto et al. . | |
| 4,392,580 | 7/1983 | Ochs . | |
| 4,573,582 | 3/1986 | Kusz . | |
| 4,648,520 | 3/1987 | Stull . | |
| 4,754,890 | 7/1988 | Ullman et al. . | |
| 4,872,571 | 10/1989 | Crecelius et al. . | |
| 4,934,544 | 6/1990 | Han et al. . | |
| 4,954,191 | 9/1990 | Delespaul et al. . | |
| 4,961,986 | 10/1990 | Galda et al. . | |
| 5,004,111 | 4/1991 | McCarthy . | |
| 5,346,083 | 9/1994 | Song et al. . | |
| 5,372,268 | 12/1994 | Han . | |
| 5,513,781 | 5/1996 | Ullrich et al. | 215/347 X |
| 5,551,608 | 9/1996 | Moore et al. | 215/349 X |
| 5,875,909 | 3/1999 | Guglielmini | 215/350 |

*Primary Examiner*—Stephen K. Cronin
*Attorney, Agent, or Firm*—Welsh & Katz, Ltd.

[57] ABSTRACT

A liner for use with a threaded closure cap is formed of a relatively thin, flexible material having a central portion configured for placement in the cap abutting a top wall thereof. The liner has at least one tab extending therefrom. The tab has a leading edge portion that is formed so as to define an angle relative to a tangent line adjacent to a juncture of the tab and the central portion. The angle of the tab is configured to be the same as the angle of the threads in the closure cap so that the tab rests fully against the threads prior to application of the closure to an associated container.

15 Claims, 1 Drawing Sheet

ANGLED TAB CLOSURE LINER

FIELD OF THE INVENTION

This invention relates to a closure liner having an angled pull tab. More particularly, the invention relates to a closure liner of the tab-down type, having an angled pull tab leading edge.

BACKGROUND OF THE INVENTION

Container closures are available in a variety of configurations and constructions. One type of closure includes a threaded cap portion that threadedly engages a complementary thread on a container neck. Another type of closure includes a snap-type cap having a locking bead around a portion of the cap depending skirt, that engages a complementary locking portion on a container.

In order to provide visibly discernable evidence of tampering, a number of tamper indicating configurations have come into widespread use. In one type of tampering indicating arrangement, the closure cap includes a tamper evident band that depends from the cap skirt. The band fractures or separates, either fully or partially, from the skirt portion as the cap is removed from the container to provide tamper indication.

Another arrangement includes a sealing liner positioned between the closure and an upper sealing edge of the container neck. The liner is then sealed, such as by heat sealing, to the sealing edge of the container neck. In this manner, access to the inside of the container is possible only by breaking or removing the liner from the container.

In one known liner arrangement, a pull tab is formed as part of the liner. The pull tab can be configured to retain the liner in the closure prior to applying the closure to a container. The tab can also be configured to facilitate removing the liner from the container.

In some known arrangements, the liner contains a plurality, e.g., three, such tabs. The pull tab is a relatively small, integral extension of the liner that extends beyond the periphery of the liner that is sealed to the container neck edge. Such pull tabs are well known in the art.

In order to integrate the pull tab with the closure package, e.g., a closure cap and container, a variety of configurations are known. In one arrangement, the tab is folded over the liner so as to rest within the periphery of the liner, between the liner and the top wall of the cap when the closure cap is placed over the liner, on to the container. In another known configuration, referred to as a tab-down configuration, the pull tab is folded downwardly, onto the container neck, in conjunction with placing the closure on the container. In this manner, the pull tab does not interfere with subsequent sealing of the liner to the container neck. Pull tabs of the tab-down configuration can extend over the container and closure threads.

There are, however, a number of drawbacks to the tab-down arrangement. First, it has been observed that the tabs may tend to push the liner slightly toward the cap thread. As the tab pushes toward the thread, the pressure can cause the liner to protrude inside of the cap, exposing it to potential contact with the container edge, during cap application. This, in turn, can cause incomplete contact between the liner and the container neck edge. It has also been observed that the tab can push inward, toward the center of the liner, again causing incomplete contact between the liner and the container neck edge during cap application. Those skilled in the art will recognize that this incomplete contact can result in failure to effect a complete seal of the container, and thus an unacceptable seal.

Accordingly, there continues to be a need for a container closure liner tab of the tab-down type that maintains the liner in position in the closure prior to applying the closure onto a container. Such a pull tab maintains the positioning of the liner, while minimizing or reducing interference with application of the closure to a container. Further, such a pull tab provides sufficient gripping area for a user to remove the liner from the container upon first use.

SUMMARY OF THE INVENTION

A liner for use with a closure cap and a container includes a central portion defining a periphery thereof and at least one, and preferably a plurality of tabs extending outwardly from the central portion at the periphery.

Each tab is formed with an angled leading edge portion. That is, the leading edge is formed so as to define an angle greater than zero degrees and less than 90 degrees relative to a tangent line adjacent to a juncture of the tab and the central portion. In a preferred embodiment, the leading edge portion angle is formed about equal to the angle of the threads in the closure cap skirt.

The angled leading edge portion provides a relatively large area of contact between the liner and the closure cap to maintain the liner in position in the cap prior to applying the cap to a container.

In a most preferred embodiment, the liner includes three tabs that are equally circumferentially spaced from adjacent tabs. An anticipated liner is formed of a laminate material, and includes an adhesive material so that the liner can be sealed to the container upon application of the closure thereto.

Other features and advantages of the present invention will be apparent from the following detailed description, the accompanying drawings, and the appended claims.

DETAILED DESCRIPTION OF THE PREFERRED EMBODIMENTS

Figure 1:
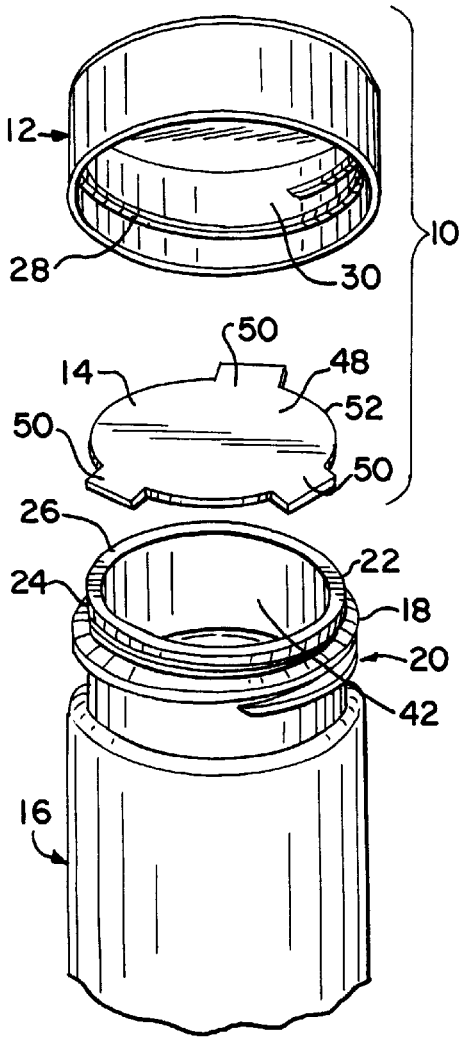
FIG. 1 is an exploded, perspective view of an exemplary closure package, including a closure cap and a liner embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

FIG. 1 shows a closure package 10 including a closure cap 12 and a liner 14 embodying the principles of the present invention. The package 10 is for use with an associated container 16. The exemplary container 16 has a finish 18 having a threaded neck portion 20. The finish 18 is that portion of the container 16 including the upper region 22 which engages the cap 12, e.g., the threaded area 24 and an uppermost sealing surface 26 of the container 16. The container threads 24 engage complementary threads 28 formed on an inner surface 30 of the cap 12.

The cap 12 has a top wall portion 36 and a depending skirt portion 38 depending from the top wall portion 36. The inner surface 40 of the top wall portion 36 is adapted to coact with the sealing surface 26 of the container 16 to form a seal therebetween. The skirt 38 thread formation 28 is complementary to the container threads 24 for engaging the closure 12 with the container 16. When the package 10 is assembled, the liner 14 resides intermediate the top wall portion 36 of the cap 12 and the sealing surface 26 of the container 16, spanning the opening or mouth 42 of the container 16.

The liner 14 has a central portion 48 that is positioned over, and sealed to, the sealing surface 26 of the container 16, and at least one, and preferably three tabs 50 that are integral with the central portion 48 and extend from the periphery 52 thereof. In a most preferred embodiment, the tabs 50 are substantially symmetrically circumferentially positioned about the periphery 52 of the central portion 48. The tabs 50 define grasping portions, outside of the sealed periphery 52 of the central portion 48, that facilitate removing the liner 14 from the container 16.

Those skilled in the art will recognize that the liner 14 can be formed from a variety of materials, including foil, fibrous, e.g., pulp-based material, polymeric materials such a polyethylene, resilient materials e.g., closed cell foams, and the like. Such liners 14 can also be formed from a laminate including any of the aforementioned liner materials. Such a laminate can include a foil element to provide gas impermeability characteristics for the liner. Typically, such a liner 14 includes a heat activated bonding layer such as a heat activated adhesive, applied to the liner 14 on a side adjacent to the container sealing surface 26. Such liners 14 permit the cap 12 to be closely fitted to, and tightened onto, the container 16.

Figure 2:
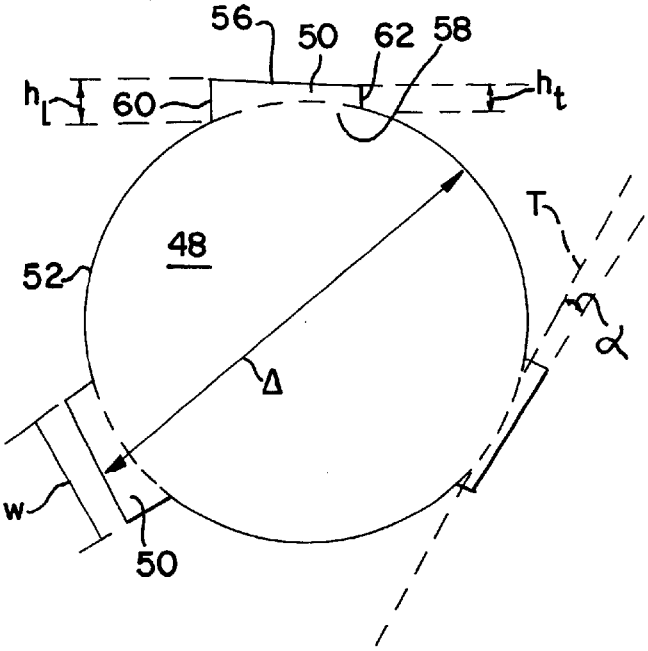
FIG. 2 is top plan view of the liner illustrated in FIGn 1, the liner being shown with three angled tabs.
Figure 3:
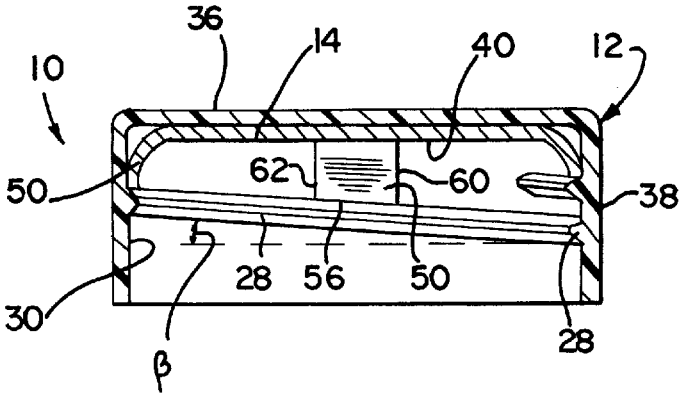
FIG. 3 is a cross-sectional view of an exemplary closure showing the liner positioned therein.

As can be seen from FIG. 2, the tabs 50 each include an angled leading edge portion 56. The angle a is formed relative to a tangent line, as indicated at T, adjacent to a juncture (indicated at 58) of the tab 50 and the liner central portion 48. In a preferred embodiment, the angle $\alpha$ is about equal to the angle $\beta$ (as seen in FIG. 3) of the thread 28 formed in the cap skirt 38. That is the tab angle $\alpha$ is such that the leading edge 56 is parallel to, and can be abutting, the threads 28 in the cap 12 when the liner 14 is positioned therein. In a most preferred embodiment, the angled edge 56 is straight and is formed to conform to the closure thread angle $\beta$.

In a current embodiment, for use with an exemplary 53 mm closure 12 having a six pitch thread 28, each tab 50 extends from the liner central portion 48 and has a width W of about 0.5 inches, a leading height $h_1$ (indicated at 60) of 0.115 inches and a trailing height $h_r$ (indicated at 62) of 0.128 inches. The angle $\alpha$ in the exemplary embodiment, is about 1.4°. The angle $\alpha$ can be between about 0.5° and about 4.0°. Those skilled in the art will recognize that the angle $\alpha$ will vary depending upon the diameter of the closure 12 and the thread pitch.

The present angled leading edge tab 50 provides a number of advantages over known tabbed liner configurations. First, as seen in FIG. 3, the area of contact between the closure thread 28 and the liner tab, 50, prior to application of the closure 12 to the container 16, is significantly larger in the present angled leading edge tab 50 when compared to radius tab or square tab configurations. In a typical assembly operation, the liner 14 is formed separately from the closure 12. The liner 14 is then positioned in the closure 12, abutting the top wall 36 thereof. The closure 12, with the liner 14 positioned therein can then be stored or shipped to a bottling or canning facility. The closure 12 can then be positioned on the container 16, and the liner 14 sealed to the container by methods that will be recognized by those skilled in the art.

Generally, the liners 14 are fabricated such that when measured at an outermost diameter D (the diameter including one or more tabs 50), the liners 14 are somewhat larger than the inside diameter of the closure 12. Thus, the liner tabs 50 will fold or bend away from the top wall 36, toward the thread 28 in the skirt portion 38.

Unlike known tabs, the contact area of the tabs 50 with the threads 28 is completely or at least significantly fully across the width W of the present angled tabs 50. Because the area of contact is significantly greater in the present angled tab 50 configuration, the tab 50 is less likely to fall out or be displaced from the closure 12. This is particularly important where, as in most such manufacturing operations, the liner 14 may be positioned in the closure 12 a significant period of time prior to "capping" the container 16.

Moreover, the "matching" angles $\alpha$, $\beta$ of the tab leading edge 56 and the cap threads 28 provides complementary surfaces which tend to prevent "bunching" or shifting of the liner 14 when it is positioned in the closure 12. Those skilled in the art will recognize that this reduces the opportunity for sealing failure when the closure 12 and liner 14 are fitted onto a container 16, due to improper positioning of the liner 14 on the sealing surface 26. In addition, the present angled tab 50 provides an increased "tab length" which facilities liner 14 removal by a user.

Those skilled in the art will recognize that although an exemplary embodiment of the liner 14 having three angled tabs 50 is discussed above, the present invention is not intended to be limited to such an exemplary liner 14. Rather, the present liner 14 can include any number of tabs 50 positioned symmetrically or asymmetrically about the periphery 52 of the liner central portion 48.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A liner for use with a closure cap and a container, the cap having a top wall portion and a depending skirt portion having an internal thread formation, the container having a finish portion having an external thread formation complementary to the cap thread formation for engagement therewith, the container having a sealing surface, the liner comprising: a relatively thin, flexible material having a central portion configured for placement in the cap abutting the top wall portion and at least one tab extending therefrom, said at least one tab having a leading edge portion formed so as to define an angle greater than 0° and less than 90° relative to a tangent line adjacent to a juncture of said tab and said central portion.

2. The liner in accordance with claim 1 including an adhesive disposed on a surface thereof.

3. The liner in accordance with claim 1 wherein said angle is between about 0.50° and about 4.0°.

4. The liner in accordance with claim 1 wherein said liner is formed of a foil material.

5. The liner in accordance with claim 1 including a plurality of tabs.

6. The liner in accordance with claim 3 wherein said tabs are equally circumferentially spaced from adjacent tabs.

7. The liner in accordance with claim 1 wherein said liner is formed of a laminate.

8. The liner in accordance with claim 7 wherein said laminate includes a foil layer.

9. A closure package for use with an associated container, the container having a finish portion having an external thread formation and a sealing surface at an uppermost portion thereof, the package comprising:

a closure cap having a top wall portion and a depending skirt portion depending from said top wall portion, said top wall portion being adapted to coact with the container sealing surface to form a seal therebetween, said cap including a thread formation for engaging said container thread formation; and a liner disposed in said cap and positioned intermediate said top wall portion and the sealing surface when said cap is positioned on the container, said liner having a central portion and at least one tab portion integral with said central portion, said at least one said tab extending outwardly from a periphery of said central portion and having a leading edge portion formed so as to define an angle greater than 0° and less than 90° relative to a tangent line adjacent to a juncture of said tab and said central portion.

10. The closure package in accordance with claim 9 wherein said cap thread is formed at a predetermined pitch angle, and wherein said tab angle is about equal to said predetermined pitch angle.

11. The closure package in accordance with claim 9 including an adhesive disposed on a surface of said liner.

12. The closure package in accordance with claim 9 wherein said leading edge portion angle is between about 0.5° and about 4.0°.

13. The closure package in accordance with claim 9 including a plurality of tabs.

14. The closure package in accordance with claim 13 including three tabs.

15. The closure package in accordance with claim 13 wherein said tabs are equally circumferentially spaced from adjacent tabs.

* * * * *